US007837232B2

(12) United States Patent
Richards

(10) Patent No.: US 7,837,232 B2
(45) Date of Patent: Nov. 23, 2010

(54) PROTECTIVE SKI APPLIANCE

(76) Inventor: William M. Richards, 608 S. Magnolia Ave., West Covina, CA (US) 91791

( * ) Notice: Subject to any disclaimer, the term of this patent is extended or adjusted under 35 U.S.C. 154(b) by 699 days.

(21) Appl. No.: 11/725,765

(22) Filed: Mar. 20, 2007

(65) Prior Publication Data

US 2007/0222202 A1 Sep. 27, 2007

Related U.S. Application Data

(60) Provisional application No. 60/786,122, filed on Mar. 27, 2006.

(51) Int. Cl.
*A63C 11/00* (2006.01)

(52) U.S. Cl. ..... 280/809; 280/816; 280/821; 280/606

(58) Field of Classification Search ..... 280/809, 280/816, 819, 821, 606
See application file for complete search history.

(56) References Cited

U.S. PATENT DOCUMENTS 2,564,420 A * 8/1951 Brown ..... 280/14.28
3,689,092 A * 9/1972 Lake ..... 280/606
3,738,674 A * 6/1973 Pauls ..... 280/816
3,833,233 A * 9/1974 Sugiyama ..... 280/12.14
3,862,765 A 1/1975 Goheen
3,948,535 A * 4/1976 Negi ..... 280/816
4,101,142 A * 7/1978 Turner ..... 280/16
4,413,832 A * 11/1983 Pendleton ..... 280/845
4,744,584 A * 5/1988 Monreal ..... 280/606
4,938,698 A * 7/1990 Chantry ..... 434/253
5,295,715 A 3/1994 Van Blaricom
D349,144 S 7/1994 Greene
5,665,058 A 9/1997 Young
5,876,066 A 3/1999 Petkov
5,930,835 A 8/1999 Silvestri
6,460,891 B1 10/2002 Jones
6,592,150 B2 7/2003 Kernan
6,855,024 B2 2/2005 Rothschild

OTHER PUBLICATIONS

Web page, www.mgt-healthcare.com/product/Outrigger/outrigger.html, Outrigger, *The ShockShaft F-1,* Feb. 28, 2007, 2 pages.

* cited by examiner

*Primary Examiner*—Paul N Dickson
*Assistant Examiner*—Bridget Avery
(74) *Attorney, Agent, or Firm*—Fulwider Patton LLP

(57) ABSTRACT

A hand held protective ski appliance including a ski no longer than 18" inches long and including a handle extensive with the direction of the ski and spaced therefrom about 3" inches.

14 Claims, 2 Drawing Sheets

FIG. 5
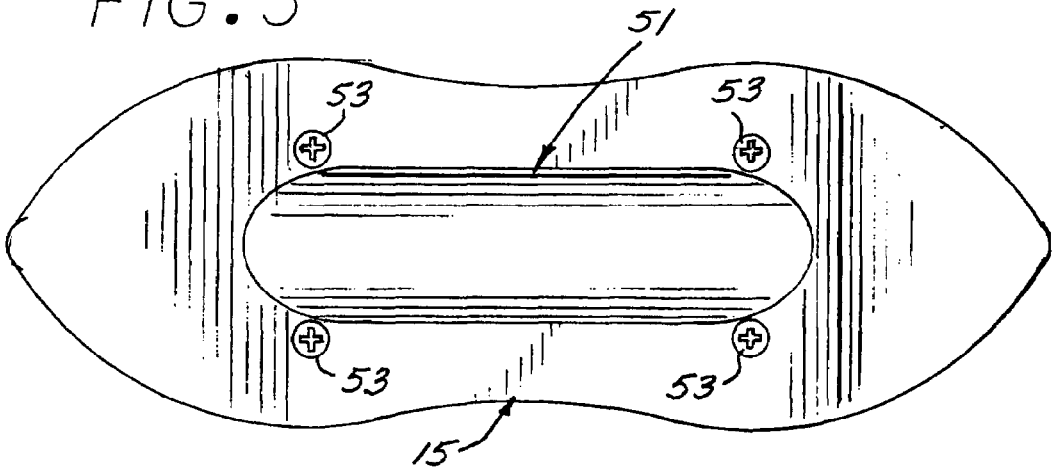
FIG. 6
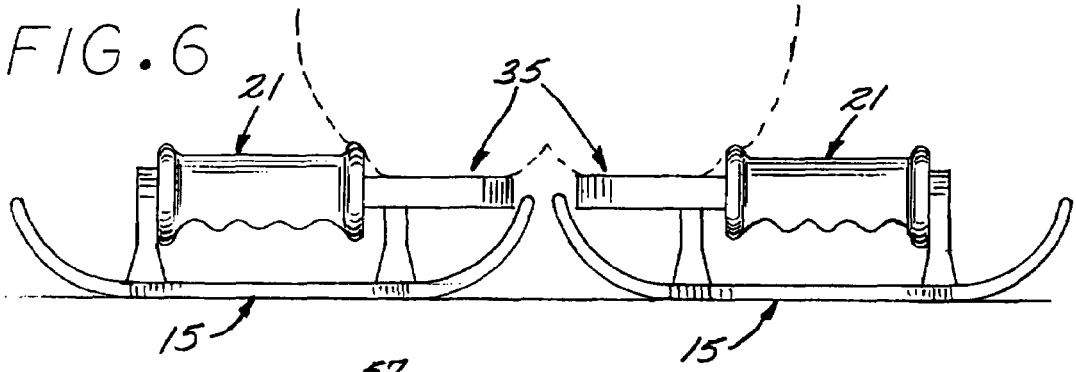
FIG. 7
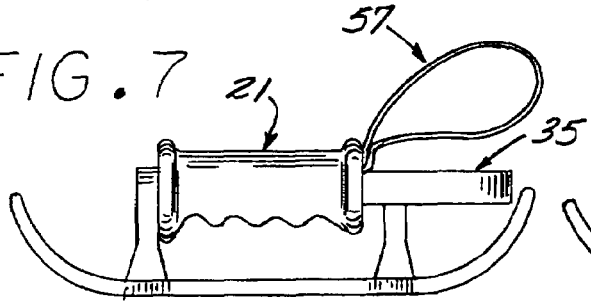
FIG. 8
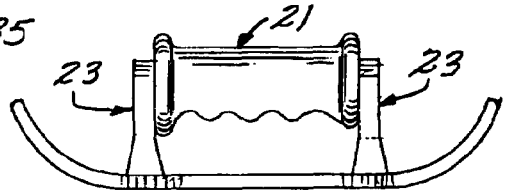
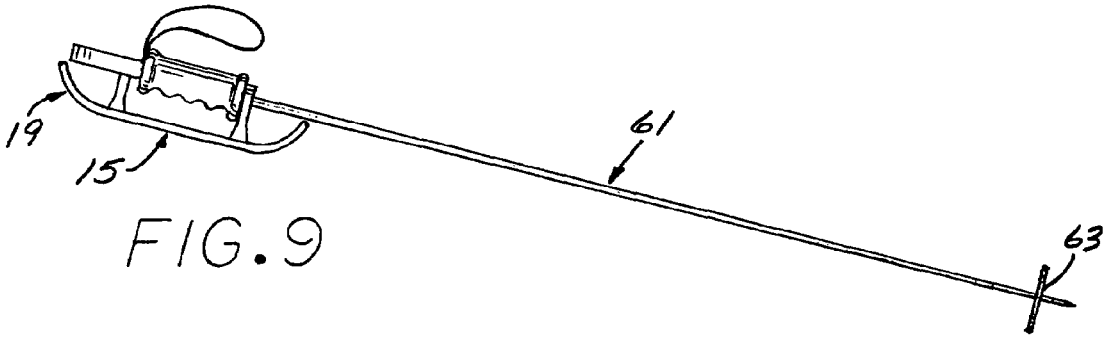
FIG. 9

PROTECTIVE SKI APPLIANCE

CROSS-REFERENCES TO RELATED APPLICATIONS

This is a non-provisional continuation-in-part application claiming priority to provisional application No. 60/786,122, entitled Hand Held Sliding Surface For Snow Sports Used With Or Without Snow Ski Pole, Also Convenient For Hand Protection And Resting On While Stationary, filed on Mar. 27, 2006, which is hereby incorporated by reference in its entirety.

BACKGROUND OF THE INVENTION

1. Field of the Invention

The present invention relates to snow sports such as snowboarding and alpine and cross country skiing.

2. Description of the Prior Art

Skiing has become an extremely popular sport throughout the mountainous regions of the world and lends great entertainment value to the participants. The sport is fraught with risk of injury. Those risks have been long recognized and have been addressed in many different ways, as by supplying safer skis, ski bindings and ski boots which afford support to the athlete and provide for release in the event of a fall or lose of control all in effort to minimize injury to the skier. Likewise, in snowboarding many improvements have been made to protect the lower extremities by providing for articulation of the boot mounts and release thereof.

In the meantime, little attention has been given to the injuries of the upper extremities during a high speed fall or loss of control.

Downhill skiers typically use long ski polls for support with handles at the top and baskets at the lower extremity to limit penetration into the snow of the pole tip. Some attention has been given to the injuries to the skiers hand and thumb from falls causing a forceful disengagement of the skiers hand from the pole and the safety strap attaching the hand to the pole.

Consequently, skiers, and particularly snowboarder's, have been left without meaningful protection against injury of the upper extremities during a fall when the skier's natural inclination is to reach his or her arm out toward the snow surface during the fall causing abrupt and violent contact with the snow thus resulting in the hand, wrist, elbow and often times shoulder injury from the sharp impact, frequently resulting in hospitalization and often times surgery.

It has been proposed to form a ski pole handle with a strut hand hold projecting laterally from the upper end thereof and turning downwardly to project parallel to the handle and form a narrow longitudinal runner. A device of this type is shown in U.S. Pat. No. 3,862,765 to Goheen.

While providing some support for certain exhibition maneuvers wherein the skier is facing forwardly and might lean over and apply weight to the runner as it moves along the hard pack snow surface, such devices have not been generally accepted and have little utility should a skier or snowboarder take a fall impacting the snow in a disorganized manner, sometimes inverted or facing uphill, resulting in disengagement from the ski pole itself.

SUMMARY OF THE INVENTION

The present invention includes a small ski having a hand hold thereon to allow the ski to be portably carried by a snowboarder during a downhill run and allowing the snowboarder to engage the ski against the snow to, as high speed downhill travel progresses, slide the ski along the surface of soft snow or the like to partially support continued downhill travel and minimize the prospects of abrupt high forces to the skier's arm and/or shoulder during a fall.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 5 is a top view thereof of the hand held ski appliance shown in FIG. 5;

FIG. 6 is a side view, in reduced scale, of a pair of hand held ski appliances shown in FIG. 1 and depicting a snowboarder resting thereon;

FIG. 7 is a side view of a second embodiment of the hand held ski appliance of the present invention;

FIG. 8 is a side view depicting a third embodiment of the hand held ski appliance of the present invention; and FIG. 9 is a side view of a fourth embodiment of the hand held ski appliance of the present invention as incorporated in a ski pole.

DETAILED DESCRIPTION OF THE PREFERRED EMBODIMENTS

Figure 1:
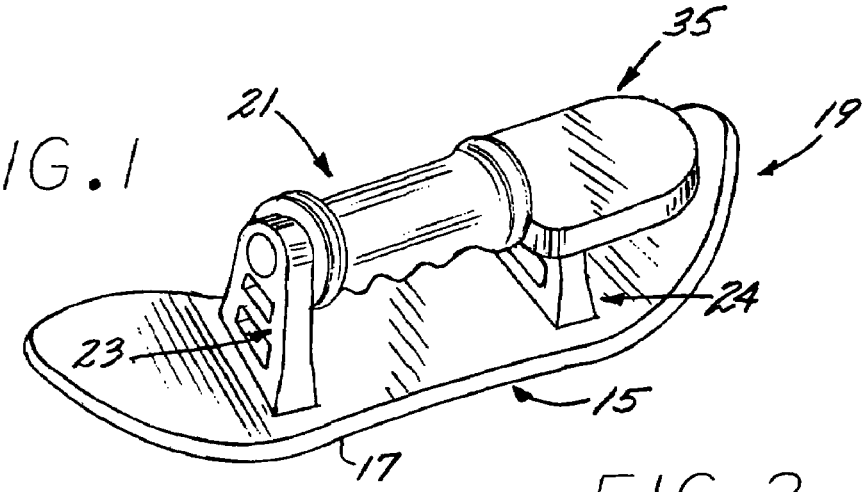
FIG. 1 is a perspective view of a hand held ski appliance of the present invention.
Figure 2:
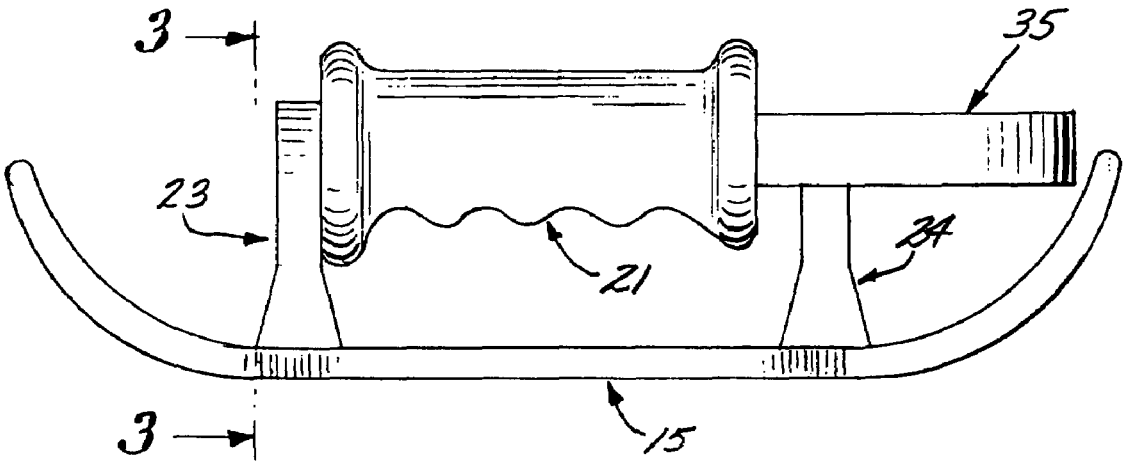
FIG. 2 is a side view thereof in enlarged scale.
Figure 3:
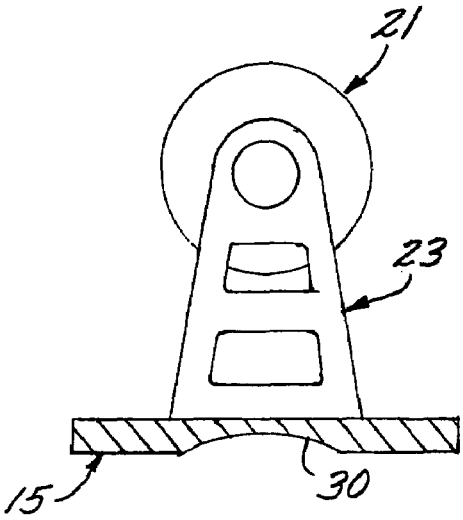
FIG. 3 is a left hand end view thereof partially in sections.

Referring to FIGS. 1-3, the protective ski appliance of the present invention includes, generally, a short ski 15 on the order 6"-18" inches long and formed with a downwardly facing typically flat planar surface 17 and configured on at least one end with an upturned shovel 19. A handle, generally designated 21 is surmounted on the ski 15 by means of one or more struts, generally designated 23 and 24 to project parallel to the ski. Thus, a snowboarder or the like using the appliance may grasp one in each hand, about the respective handle 21, and embark on a snowboard adventure down the slops. In the event of a loss of control, fall or the like, the natural reaction of the snowboarder is to extend his or her arm to engage the underlying snow during a fall in effort to break the impact. With the appliance of the present invention, the ski 15 will absorb the impact as it contacts the snow surface to slide there along thus breaking up the force vector which would otherwise be applied to the arm and shoulder of the snowboarder thereby tending to break the fall and minimize forces on the snowboarder's arm, including the elbow and shoulder to thereby minimize injury from the impact.

With the current popularity of snowboarding and exhibition skiing, often times selected areas of a ski slope are set aside for special grooming, jumps, half pipes and the like thereby inducing athletic skiers and snowboarder's to undertake acrobatic maneuvers often times resulting, particularly during practice runs, in uncoordinated landings which redirect the snowboard or the skis in abrupt fashion thus leading to what can sometimes be a catastrophic fall. The tendency of the snowboarder or skier is to extend the downhill arm which, upon impact with the snow surface, can result in application of a high magnitude of inertia from the skier's body being applied to the arm and shoulder area. This impact often leads to significant injury to the skier's upper extremities, shoulder and sometimes the clavicle.

Typically, snowboarder's do not use ski poles or the like thus leaving them totally defenseless for any break in the fall or reduction in forces applied to the upper extremities upon impact. It is this situation to which the present invention is directed.

Skiers and snowboarder's typically maneuver over numerous various terrain involving different undulations and incline undertaking turns and maneuvers, often times attracted by looser snow and powder along the sides of a run where falls may well take place. It is desirable that the appliance of the present of invention provide for support in sliding relationship along the top surface of the loose snow or powder without the arm or hand digging deeply into the powder, an occurrence which could contribute to an application of abrupt force tending to dislocate the affected arm member.

As appreciated by those skilled in the art, the short ski 15 should have sufficient ski surface on the underside to provide support in sliding over soft or loose packed powder or over otherwise loose snow without digging into the loose snow and providing resistance to downhill skidding of the ski.

As will appreciated by those skilled in the art, the ski 15 must thus have sufficient supporting surface to maintain sliding support even during a fall when the entire weight of the snowboarder or skier might be applied to the ski. While the ski may take many different configurations and dimensions to provide the support surface, it is believed that an overall length of about 6 inches is required for the support surface 17 and up to about 18 inches, with a preferred length of about 9 or 10 inches being desirable, with a width of some substantial dimension, as for instance, at least 2½ inches and up to about 5 inches over all, preferably about 4 inches at the widest point. A minimum support area of about 15 square inches provides favorable performance. The ski itself may be made of conventional ski composites, wood, metal or any other desirable well known material.

The ski is preferably constructed with an upturned shovel 19 on at least one end and will typically be carried by the skier or snowboarder facing downhill in the direction of travel so that, in event of a fall, the forwardly facing skier will tend to extend the downhill arm and typically engage the ski shovel 19 facing downhill in the direction of travel to thus prevent the ski itself from digging into the snow and tending to induce the ski to ride up over the top of any loose snow or powder. In the preferred embodiment, the ski is configured with shovels 19 on both ends to thereby provide a double ended ski in the event so that the user may hold the ski without consideration without orientation in a direction facing downhill. Also, with a double ended ski, 15 in the event the skier or snowboarder embarks on a fall sometimes referred to as a "windmill", the ski will be effective upon impact when facing in either direction of travel so as to ride up over the top surface of the snow. The underside of the ski if formed with a longitudinal directional groove 30.

Figure 4:
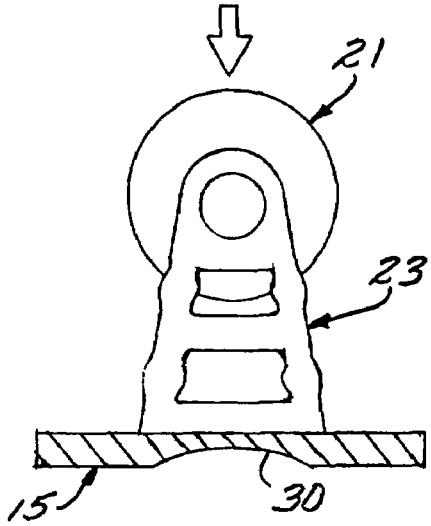
FIG. 4 is a right hand end view thereof partially in sections.

Referring to FIG. 4, the struts 23 may be constructed of resilient, compressible material such as plastic or spring metal to, under a predetermined load, such as that typically with risk of shoulder injury i.e. about 50 lbs. to flex and absorb some of the load as the struts 23 flex from the fully extended position shown in FIG. 3 to the shock absorbing position shown in FIG. 4.

Referring to FIGS. 1, 2 and 6, in the preferred embodiment, the ski appliance of the present invention includes an axle projecting from the handle 21 and mounting a miniature seat, generally designated 35 supported over the strut 24 and nested over the ski inside the upturn tip of one of the shovels 19.

In use, it will be appreciated that the protective ski appliances of the present invention may be conveniently packed with the user's boots or otherwise in his or her travel luggage or backpack to be available at the ski slope. When the snowboarder or skier reaches the ski slope, he or she may reach into his or her backpack and retrieve the protective ski appliance for use in a downhill run. When a downhill run is to be commenced, the snowboarder skier may grasp an appliance in each hand and maneuver the hands freely during the run as is normal for a snowboarder. As a snowboarder leans to one side or the other of the board it will be appreciated that the appliance may be extended toward the snow to provide for lateral support during any acrobatic maneuvers and may even be utilized to facilitate extreme exhibitionist moves.

In the event of a fall or the like, the snowboarder will want to retain a grasp on the handles 21 and he or she will typically inherently be induced to extend the hand on the side toward which the fall is underway thus extending the ski 15 on that side toward the snow surface. In the event, the snowboarder completely leaves his or her feet it will be appreciated that the entire force generated by the momentum of the snowboarder hurdling down the slope, will cause the downhill ski to engage the snow surface with tremendous force. The snowboarder will endeavor to direct the ski appliance longitudinally along the snow surface in the direction of the momentum of the fall. The initial engagement of the ski 15 at high speeds with the surface of the snow, even for loose, packed or powder will tend to cause the shovel 19 at the downhill end of the ski 15 to ride along the snow surface and be elevated there along to be maintained on the top surface of the snow to thus provide for sliding of the ski 15 and avoid abrupt stop or diving deep into the snow surface which might otherwise generate trauma in the snowboarder's arm and/or shoulder.

It will be appreciated that the initial force typically takes place directed in a downward direction along the incline thus causing the ski to impact the inclined snow surface moving downwardly along the direction of the fall. The groove 30 will cooperate in tending to keep the ski directed in the desired orientation on the snow as dictated by the orientation of the handle carried in the user's hand.

The force of impact which may well be on the order or a couple of hundred pounds will typically be broken up into a somewhat vertical component perpendicular to the angle of the incline and somewhat horizontal component along the direction of the incline. This breaking down of the impact forces will tend to minimize the shock on the snowboarder's extended arm and consequent trauma to the arm and shoulder.

As the snowboarder progresses on downhill during the fall, the force applied to the protective ski appliance will be reduced due to the decrease in momentum thus tending to dissipate the dangerous and injurious forces which would otherwise be experienced.

For situations where the initial impact might be directed along a force more perpendicular to the snow surface, the overall force may well exceed 100 lbs. or more. To facilitate absorption of those forces, the struts 23 and 24 are constructed such that, at about 50 lbs. of force, they tend to flex, bend, or otherwise contract to absorb the impact forces in a spring like manner to reduce or eliminate trauma to the arm and shoulder (FIG. 4).

As the ski 15 is directed along the downwardly inclined path of travel, the groove 30 will tend to capture a ridge of snow under the ski surface 17 to thus cooperate in maintaining a direction of travel longitudinal to the ski itself thereby minimizing erratic and dangerous unwanted turning of the ski relative to the snowboarder's arm.

In the preferred embodiment, the ski 15 is contoured in somewhat of an hour glass shape along the opposite edges thereof to facilitate turning thereof in the event the user elects to turn the ski on the snow surface, by twisting of his or her hand either in an acrobatic maneuver or during a progressive fall to maintain the desired direction of travel.

As will be appreciated by those participating in the sport, snowboarder's face the difficulty that, unlike skier's who typically have long poles to lean on, have limited resources to facilitate resting during there decent. Often times snowboarder's are forced to merely bring there snowboard to a stop transverse of the slope and then sit down directly on the snow thus resulting in a high rate of heat transfer from the snow to the snow boarders body and creating a somewhat awkward maneuver as the snowboarder later endeavors to arise from the sitting position.

Referring to FIG. 6, in one preferred embodiment the snowboarder has the option of, making a stop along the way and placing his or her hands gripping the handle down at his or her opposite sides to engage the skis 15 transversely of the slope incline and to then sit down on the transversely extending seats 35 for a comfortable rest with the buttocks supported in an elevated position above the snow somewhat insulated from the transfer of heat to snow surface. In that regard, the struts may have a length to support the handles 2"-3" above the respective skis to provide space for entry of a gloved hand and to elevate the respective seats 35 above the snow.

Referring to FIG. 5, in a second embodiment of the protective ski appliance of the present invention, the handle, generally designated 51 is connected directly to the top ski surface by means of holding screws 53.

Referring to FIG. 7, in a third embodiment the protective ski appliance incorporates a hand strap 57 which may be employed to wrap about the wrist of the snowboarder to allow the appliance to be suspended from the snowboarder's wrists.

Referring to FIG. 8, the protective ski appliance of the present invention may incorporate the handle 21 connected directly to the ski 15 by means of struts 23 without the addition of the snowboarder seats 35.

Referring to FIG. 9, in some instances, the protective ski appliance of the present invention may be incorporated as the handle of a ski pole, generally designated 61, having a basket 63 on the lower extremity thereof and formed to provide the benefits of allowing a skier to reach out on the downhill side during a fall to engage the ski 15 with the snow surface and to afford some degree of shock absorption and force dissipation in the event the shovel of the ski 15 happens to be pointed downhill to thus allow the body of the pole to be dragged along behind the ski.

From the foregoing, it will be appreciated that the protective ski appliance of the present invention provides economical, reliable and compact means for affording protection to a snowboarder or skier in the event of a fall during a decent down a ski run to thus minimize injury to the snowboarder and provide for a more safe and secure sporting experience.

I claim:

1. A hand held protective ski appliance to break a snowboarder's fall against a snow surface during a downhill run and comprising:

a short ski, between 6 and 18 inches long and at least 2½ inches wide and defining an elongated downwardly facing, unobstructed support surface to engage the snow surface and slide in weight-supporting relationship there along during a downhill run thereover and formed with uphill and downhill extremities and further configured at the downhill extremity with an upturned shovel;

a handle on the upper side of the ski, including an elongated hand grip parallel to, and spaced from the ski;

at least one strut connecting the handle to the ski; and a seat mounted on the ski at one end of the handle whereby a snowboarder may grasp the handle in hand on one side to embark on a downhill run over the snow surface and, in the event of a mishap causing the snowboarder to pitch over or fall to the one side, allow for the snowboarder to reach out with the one hand to engage the support surface with the snow with the shovel facing downhill to slide there along allowing the snowboarder to transfer weight to the ski to reduce the impact that would otherwise be applied to the arm and shoulder of the boarder.

2. The protector ski appliance of claim 1 wherein:

the ski is 5" inches wide.

3. The protective ski appliance of claim 1 wherein:

the ski is formed on both ends with upturned shovels.

4. The protective ski appliance of claim 1 wherein:

the ski is 6" inches long.

5. The protective ski appliance of claim 1 wherein:

the strut is flexible to apply a yielding resistance force from the handle to the ski.

6. The protective ski appliance of claim 1 wherein:

the handle is centrally located on the ski.

7. The protective ski appliance of claim 1 wherein:

the ski is double ended with upturned shovels at both ends and is symmetric about its longitudinal middle.

8. The protective ski appliance claim 1 wherein:

the ski is contoured along its opposite edges to a general hourglass shape.

9. The protective ski appliance of claim 1 wherein:

the strut includes a pair of braces supporting the opposite ends of the handle.

10. The protective ski appliance of claim 1 wherein:

the strut is relatively rigid and constructed to flex at a load of 50 pounds to facilitate absorption of forces applied to the handle.

11. The protective ski appliance of claim 1 wherein:

the strut is constructed to, upon application of a predetermined load, flex to facilitate absorbing the forces applied to the handle.

12. The hand held protective ski appliance of claim 1 that includes:

a seat mounted on the ski at one end of the handle for sitting thereon by a snowboarder.

13. The protective ski appliance of claim 6 wherein:

the handle is longitudinally and transversely symmetric about the ski.

14. A hand held protective snowboarder appliance comprising;

a double ended short ski device between 9 and 10 inches long, and between 2½ and 5 inches wide having an unobstructed planer central under surface and upturned shovels at its opposite longitudinal extremities;

an elongated handle coextensive with the ski and including a hand grip spaced from the ski for gripping by the snowboarder;

a pair of struts connecting the opposite ends of the hand grip to the ski and constructed to be flexible upon application of 50 pounds force to the hand grip toward the ski; and a seat mounted on one of the struts and projecting parallel to the ski whereby a snowboarder may grasp the hand grip in one hand and ride a snowboard over a snow surface moving the one hand about unhindered and, in the event of a fall, may reach the one hand down toward the snow surface to engage the ski with the surface to break the fall and ride the ski over the surface.

* * * * *